US006092688A

United States Patent [19]

Eberle et al.

[11] Patent Number: 6,092,688

[45] Date of Patent: Jul. 25, 2000

[54] DRAINAGE PORTS FOR PLASTIC CONTAINERS

[75] Inventors: Theodore F. Eberle, Chicago; M. A. Lateef Khan, Warrenville, both of Ill.

[73] Assignee: Crown Cork & Seal Technologies Corporation, Alsip, Ill.

[21] Appl. No.: 09/073,889

[22] Filed: May 6, 1998

[51] Int. Cl.[7] ..... B65D 1/40; B65D 1/44

[52] U.S. Cl. ..... 220/669; 215/382; 220/673; D9/538

[58] Field of Search ..... 215/379, 382, 215/383, 384; 220/670, 671, 672, 673, 674, 675, 669; D9/538, 551, 553

[56] References Cited

U.S. PATENT DOCUMENTS

| | | | |
|---|---|---|---|
| D. 401,860 | 12/1998 | Granelli . | |
| 4,890,757 | 1/1990 | Robbins, III | 215/382 X |
| 5,178,289 | 1/1993 | Krishnakumar et al. . | |
| 5,199,588 | 4/1993 | Hayashi | 220/669 X |
| 5,279,433 | 1/1994 | Krishanakumar et al. | 220/669 X |
| 5,690,244 | 11/1997 | Darr | 220/675 X |
| 5,740,934 | 4/1998 | Brady | 215/382 X |
| 5,988,417 | 11/1999 | Cheng et al. | 215/382 X |

FOREIGN PATENT DOCUMENTS

| | | |
|---|---|---|
| 0 671 336 | 9/1995 | European Pat. Off. . |
| WO 95/06593 | 3/1995 | WIPO . |
| WO 97/10998 | 3/1997 | WIPO . |

OTHER PUBLICATIONS

"Ribena" Blackcurrent 500 ml bottle (see 4 attached color 5" × 7" photos).

"Aquarius" 12 oz. bottle (see attached Figuers 1,2, 3, 4, 5 and 5A).

Powerade™ beverage container (approximately 20 oz).

*Primary Examiner*—Allan N. Shoap
*Assistant Examiner*—Joe Merek
*Attorney, Agent, or Firm*—Woodcock Washburn Kurtz Mackiewicz & Norris LLP

[57] ABSTRACT

A container that provides for drainage of fluid underneath a product label on the container is provided. The container comprises a central label portion, a bottom portion below the central label portion, and at least one drainage port. Each drainage port comprises two ridges forming a groove through which fluid can drain from the central label portion to the bottom portion of the container. At a cross-sectional area of a container at the level of the drainage ports, the container has an outer surface at a radial distance from the longitudinal axis of the container. Preferably, each groove is located at the same radial distance as that of the outer surface of the container.

5 Claims, 4 Drawing Sheets

DRAINAGE PORTS FOR PLASTIC CONTAINERS

The present invention relates to the field of containers, and more particularly to blow molded plastic containers, such as the PET bottles that are in common use today for packaging soft drinks.

BACKGROUND OF THE INVENTION

During the last twenty-five years or so, there has been a dramatic shift in the packaging of beverages, such as bottled water and soft drinks, away from glass containers and toward plastic containers. Polyethylene terephthalate (PET) is in wide use throughout the world for such containers because it exhibits such preferred characteristics as high toughness, light weight, high transparency, high pressure resistance and acts as a good gas barrier.

PET containers are commonly hot-filled, i.e., when the containers are filled with a fluid, the product is above room temperature. After filling, the containers are cooled down with a water spray. Typically, these containers also have a central label area to which a product label, referred to as a shrink-sleeve label, is applied. A problem may arise, when water or other fluid invades the area between the container and the label and becomes trapped. When water or product does not drain from this area, the trapped fluid can spoil, stains can form and/or unpleasant odors can result. Therefore, any improvement that will tend to reduce or eliminate this problem is highly desirable.

One prior art container designed to reduce any potential for the accumulation of fluid is disclosed in commonly-assigned U.S. Pat. No. 8,988,417. This patent discloses a small groove that extends from inside the central label area of the container to an area slightly below the label area so that fluid can flow down and out from underneath a label. This exemplary prior art groove for drainage is recessed from the outer surface of the container, forming a pathway between a recessed vacuum panel in the central label area to the area below the label.

Another exemplary prior art container, which is sold in Japan, has a cross section as shown in FIG. 3. This cross section is taken at the level of the groove 8 just below the vacuum panels. This prior art groove 8 is completely recessed into the container, i.e., formed completely radially inward. This prior art groove 8, however, has the adverse effects of structurally weakening the container and sometimes buckling the container under vacuum conditions. It is, therefore, desirable to provide a drainage port that maintains the structural integrity of the bottle.

It is also desirable to provide drainage ports having a structure that may be readily and accurately reproduced by a hot-mold manufacturing process.

SUMMARY OF THE INVENTION

A container that provides for drainage of fluid underneath a product label on the container is provided. The container comprises a central label portion, a bottom portion below the central label portion, and at least one drainage port. Each drainage port comprises two ridges forming a groove through which fluid can drain from the central label portion to the bottom portion of the container.

In alternative embodiments, where the container further comprises vacuum panels recessed in the central label portion, a groove extend from each vacuum panel to the bottom portion so that fluid can drain from the central label portion to the bottom portion of the container.

At a cross-sectional area of a container at the level of the drainage ports, a container has an outer surface at a radial distance from the longitudinal axis of the container. Preferably, each groove is located at the same radial distance as that of the outer surface of the container. Preferably, each ridge is substantially ramp-shaped, starting at the outer surface of the container and leading up to the outermost point of the ridge, proximate the groove.

DETAILED DESCRIPTION OF THE PREFERRED EMBODIMENTS

Figure 1:
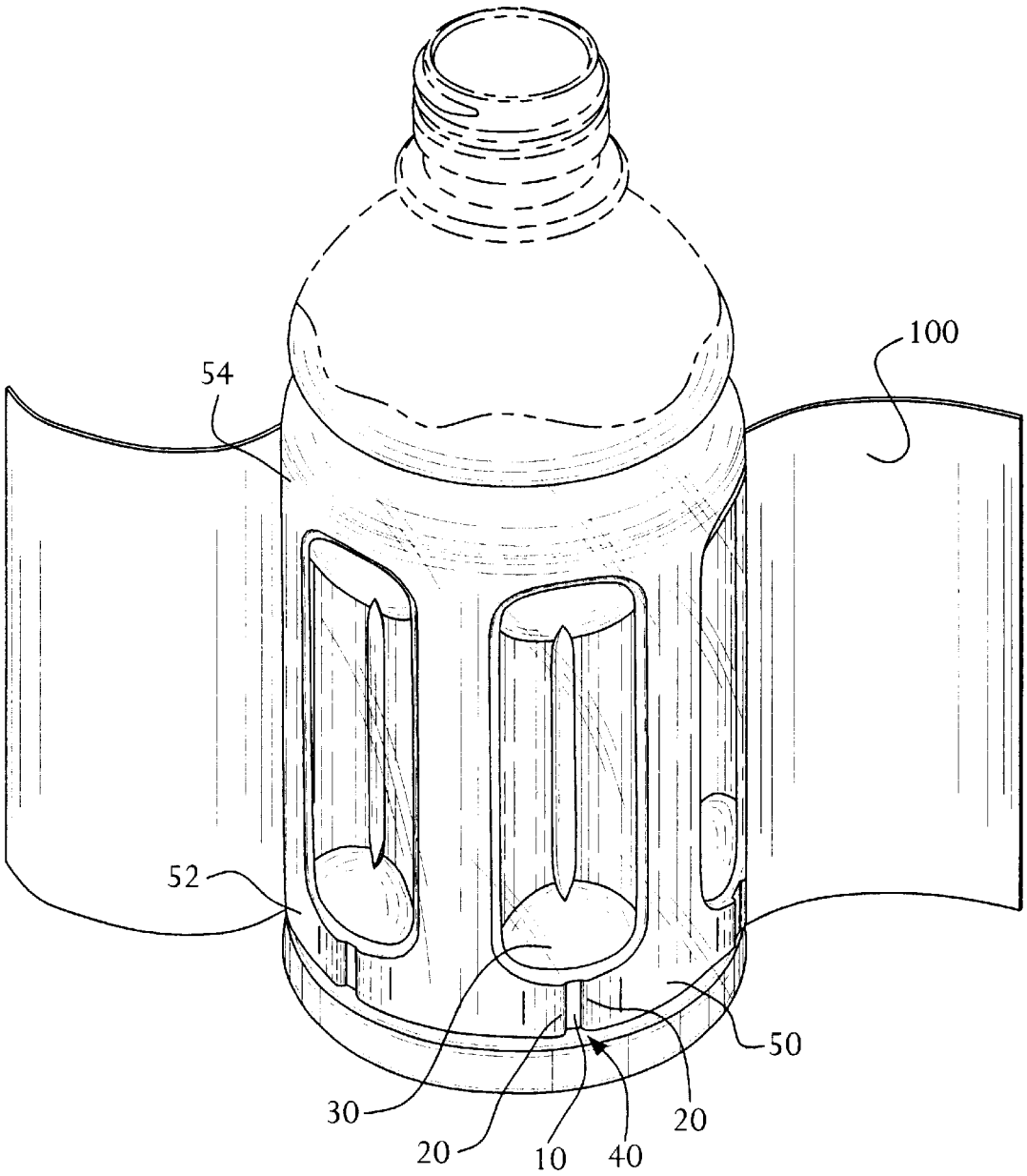
FIG. 1 is a perspective view of a preferred embodiment of a container having drainage ports according to the present invention.

A new drainage port for allowing fluid to drain from the area underneath a product label on a container, such as a blow molded plastic bottle, is provided. FIG. 1 shows a perspective view of a preferred embodiment of a container having drainage ports 40 according to the present invention. A drainage port 40 comprises two ridges 20 and a groove 10, which is formed by the ridges 20.

The area of a container where a product label 100 (shown partially affixed) is situated (or the central label area) typically extends from a first point 54 proximate the top of the container to a second point 52 proximate the bottom of the container. Normally, there are vacuum panels 30 in this central label area to add strength to the container. At least a portion of these panels 30, however, is typically recessed from the outer surface 50 of the container, thereby providing areas under the label in which fluid can hide and accumulate. Typically, the product label is a form-fitting shrink sleeve, such that it fits relatively tight on the container.

Figure 4:
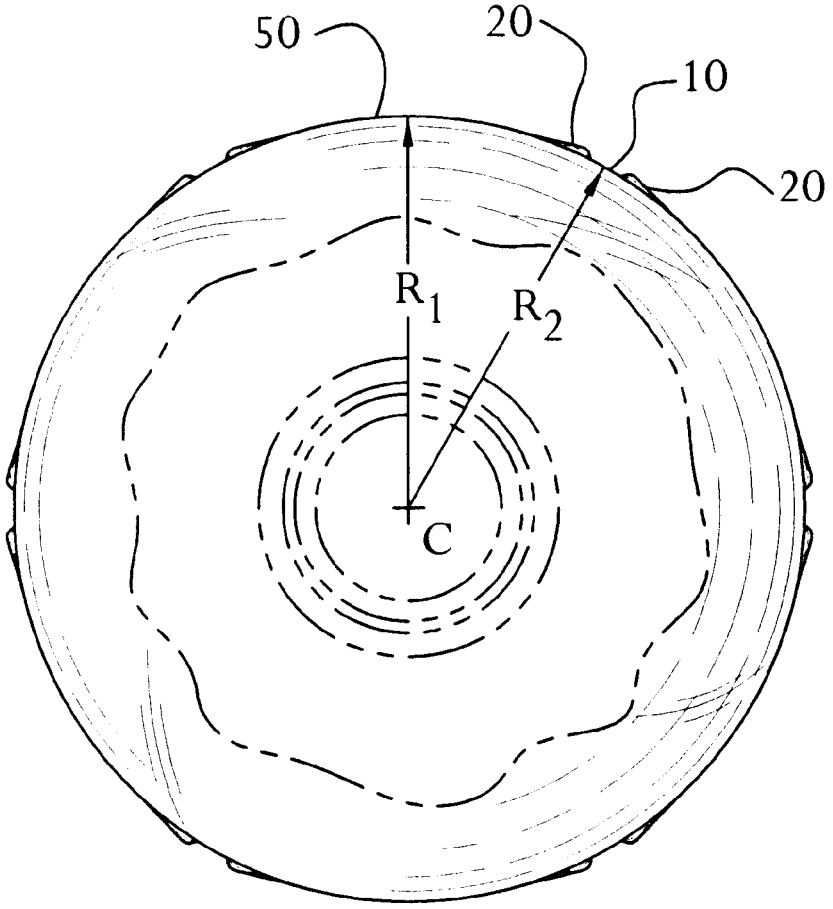
FIG. 4 is a top plan view of the container of FIG. 1.

The drainage ports 40 of the present invention provide grooves 10 that, instead of being recesses as disclosed in prior art containers, are formed by the placement of the ridges 20. FIG. 2 shows a bottom plan view of the container of FIG. 1. As seen in FIG. 2, the grooves 10 are at the same radial distance as the outer surface 50 of the container. As more clearly shown in FIG. 4, radial distance $R_1$ is the radial distance from the center axis C of the container to the central label surface 50 and radial distance $R_2$ is the radial distance from the center axis C of the container to the groove 10. In prior art containers, the grooves are recessed (directed radially inward), i.e., located at a shorter radial distance from the center axis of the container than the outer surface 50 of the container.

Figure 2A:
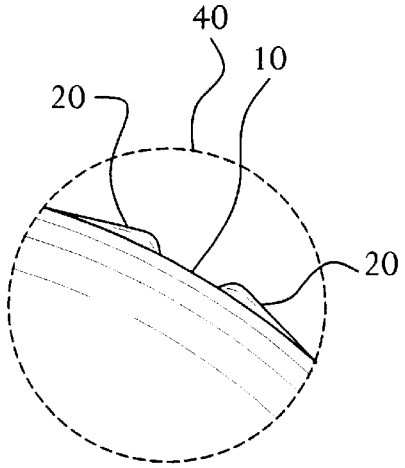
FIG. 2A is an enlarged view of a drainage port according to the present invention.
Figure 2:
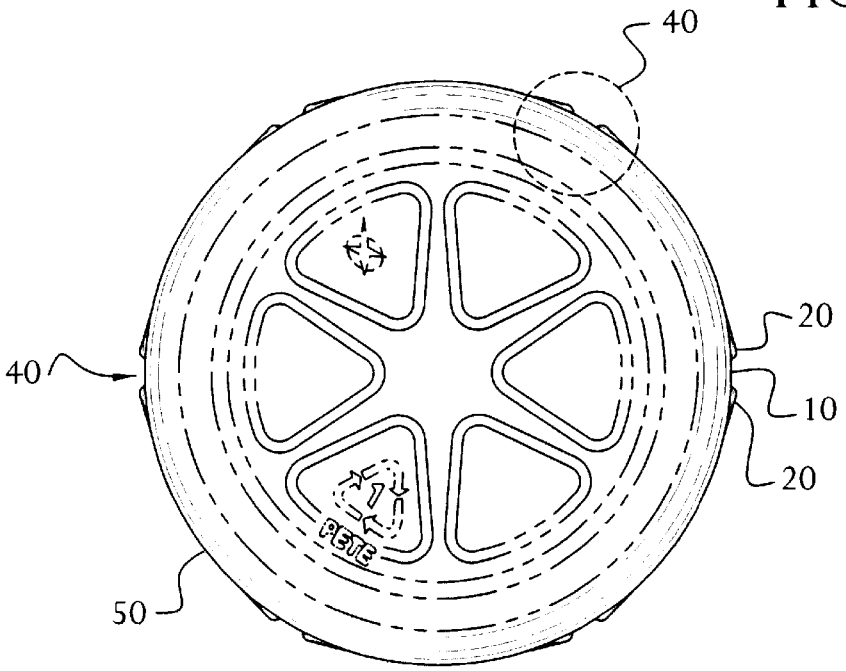
FIG. 2 is a bottom plan view of the container of FIG. 1.
Figure 3:
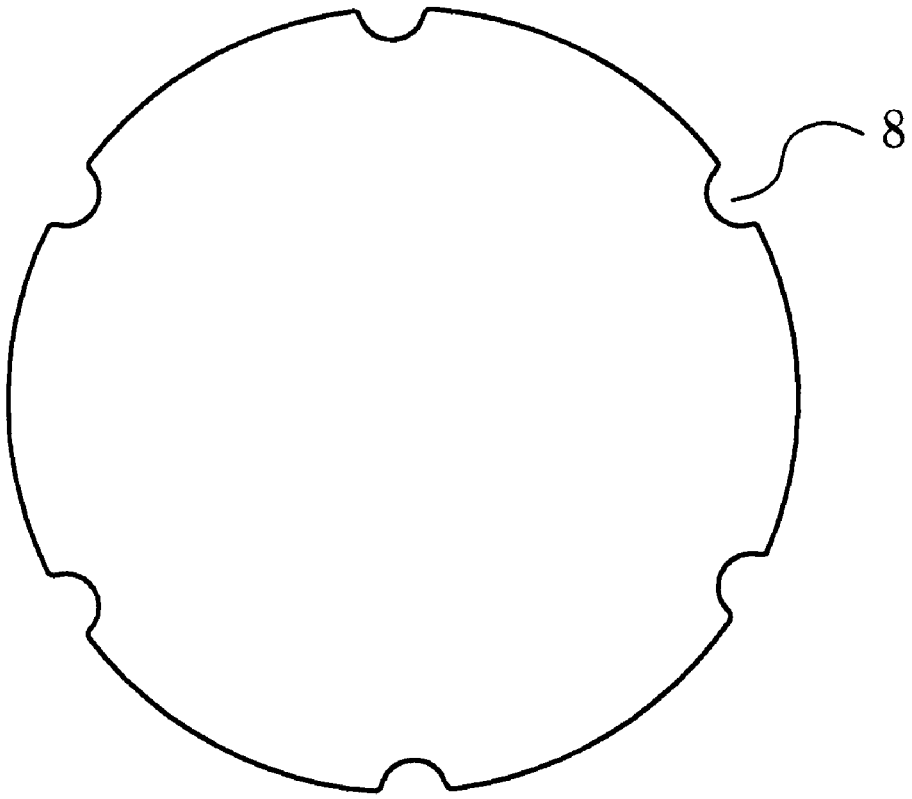
FIG. 3 PRIOR ART
FIG. 3 is a cross-sectional view of a prior art container.

FIG. 2A shows an enlarged view of a drainage port 40. It is important that the ridges 20 have height, i.e., a radial distance from the outer surface 50 of the container, so that a groove 10 will result and fluid can drain. Preferably, each ridge 20 is substantially ramp-shaped, starting at the outer surface 50 of the container and leading up to the outermost point of the ridge 20, proximate the groove 10. A product label will substantially encircle the container and cover the grooves 10, but the ridges 20 will provide sufficient space between the label and the grooves 10 for fluid to drain down and out from underneath the label.

The drainage ports 40 according to the present invention allow fluid to drain by providing space between a product label and container. Moreover, the ridges 20 provide structural strength to a container, and particularly to a PET container by stabilizing the hinge point, about which the drainage port is located. The present design also lends itself well to replication for manufacturing purposes.

Preferably, on a 12 oz. container with an outer surface 50 diameter of approximately 65 mm., the ridges 20 have a height in the range of approximately 0.3 mm. to approximately 0.8 mm., more preferably in the range of approximately 0.4 mm. to approximately 0.7 mm., even more preferably in the range of approximately 0.45 mm. to approximately 0.6 mm., and most preferably in the range of approximately 0.5 mm. to approximately 0.55 mm. Preferably, on the same container with vacuum panels having a width on the outer surface 50, i.e., encompassing a sector, of approximately 45 degrees, each groove 10 has a width in the range of approximately 2 degrees to approximately 8 degrees, more preferably in the range of approximately 2.5 degrees to approximately 6 degrees, even more preferably in the range of approximately 3 degrees to approximately 5 degrees, and most preferably in the range of approximately 3.5 degrees to approximately 4.5 degrees. Preferably, the length of the groove 10 extends from a recessed area in the central label area to a bottom portion of the container below the label. More preferably, the length of the groove 10 extends from a recessed area in a vacuum panel 30 to a bottom portion of the container below the central label area.

A preferred embodiment of a container utilizing drainage ports 40 of the present invention has one drainage port 40 extending from each vacuum panel 30. Alternatively, a container utilizing drainage ports 40 of the present invention may comprise a plurality of drainage ports 40 extending from each vacuum panel 30, including, e.g., two or more drainage ports 40 extending from each vacuum panel 30.

It is to be understood that even though numerous characteristics and advantages of the present invention have been set forth in the foregoing description, together with details of the structure and function of the invention, the disclosure is illustrative only. Accordingly, changes may be made in detail, especially in matters of shape, size and arrangement of parts within the principles of the invention to the full extent indicated by the broad general meaning of the terms in which the appended claims are expressed.

What is claimed is:

1. A container that provides for drainage of fluid underneath a product label on the container, the container comprising:

a central label portion having an outer surface to which the label is affixed, said central label portion being a generally cylindrical body having a radius defining a generally cylindrical sidewall, the radius extending between a center axis of said generally cylindrical body and the sidewall;

a bottom portion below said central label portion, said bottom portion being separated from the central label portion by a circumferential formation;

a vacuum panel recessed in said central label portion; and at least one drainage port for draining fluid from said vacuum panel comprising:

two ridges extending outward from the sidewall of the container and away from the center axis, said ridges forming a groove therebetween, the upper end of said groove being bounded by the vacuum panel and the lower end of said groove being hounded by said circumferential formation, the groove having a radius that is substantially the same in entirety from its upper end to its lower end, the radius of the groove and the radius of the sidewall being substantially the same.

2. The container according to claim 1, further comprising a label secured to said central label portion.

3. The container of claim 1, wherein the container is a plastic container.

4. The container of claim 1 having at least one drainage port for each vacuum panel on the container.

5. The container of claim 1, wherein each ridge is substantially ramp-shaped on said sidewall.

* * * * *